US007610946B2

(12) United States Patent
Morris et al.

(10) Patent No.: US 7,610,946 B2
(45) Date of Patent: Nov. 3, 2009

(54) COOLED TURBINE BLADE CAST TIP RECESS

(75) Inventors: Mark C. Morris, Phoenix, AZ (US); Steve H. Halfmann, Chandler, AZ (US); Jason C. Smoke, Phoenix, AZ (US)

(73) Assignee: Honeywell International Inc., Morristown, NJ (US)

( * ) Notice: Subject to any disclaimer, the term of this patent is extended or adjusted under 35 U.S.C. 154(b) by 126 days.

(21) Appl. No.: 11/650,265

(22) Filed: Jan. 5, 2007

(65) Prior Publication Data

US 2008/0164001 A1 Jul. 10, 2008

(51) Int. Cl.
*B22C 9/04* (2006.01)
*B22C 9/10* (2006.01)

(52) U.S. Cl. ..... 164/516; 164/369

(58) Field of Classification Search ..... 164/14, 164/132, 369, 512

See application file for complete search history.

(56) References Cited

U.S. PATENT DOCUMENTS 4,596,281 A 6/1986 Bishop
5,296,308 A 3/1994 Caccavale et al.
5,348,446 A 9/1994 Lee et al.
5,778,960 A 7/1998 Jackson et al.
6,340,047 B1 1/2002 Frey
6,468,040 B1 10/2002 Grylls et al.
6,616,410 B2 9/2003 Grylls et al.
6,637,500 B2 10/2003 Shah et al.
6,896,036 B2 * 5/2005 Schneiders et al. ..... 164/516
6,929,054 B2 8/2005 Beals et al.
2004/0112564 A1 * 6/2004 Devine et al. ..... 164/369

* cited by examiner

*Primary Examiner*—Kuang Lin
(74) *Attorney, Agent, or Firm*—Ingrassia Fisher & Lorenz, P.C.

(57) ABSTRACT

A core assembly including two cores is used to manufacture a blade. The first core has an outer surface shaped to complement the tip wall bottom surface. The second core has a tip surface, a side surface, and a protrusion or a depression. The tip surface is shaped to complement at least a portion of the tip wall top surface and is configured to be disposed proximate the first core. The side surface is shaped to complement at least a portion of the side wall, and the protrusion extends from the second core side surface to contact at least a portion of the ceramic mold inner surface. In embodiments employing a depression, the depression is formed in the side surface.

11 Claims, 7 Drawing Sheets

COOLED TURBINE BLADE CAST TIP RECESS

STATEMENT REGARDING FEDERALLY SPONSORED RESEARCH OR DEVELOPMENT

This inventive subject matter was made with Government support under DAAJ02-94-C-0030 awarded by the United States Army. The Government has certain rights in this inventive subject matter.

TECHNICAL FIELD

The inventive subject matter relates to turbine blades and, more particularly, to casting tip recesses for high temperature cooled turbine blades.

BACKGROUND

Gas turbine engines, such as turbofan gas turbine engines, may be used to power various types of vehicles and systems, such as aircraft. Typically, these engines include turbines that rotate at a high speed when blades (or airfoils) extending therefrom are impinged by high-energy compressed air. Consequently, the blades are subjected to high heat and stress loadings which, over time, may reduce their structural integrity.

To improve blade structural integrity, an internal cooling system is, in some cases, used to maintain the blade temperatures within acceptable limits. The internal cooling system directs cooling air through an internal cooling circuit formed in the blade. The internal cooling circuit consists of a series of connected, serpentine cooling passages, which incorporate pin fins, turbulators, turning vanes, and other structures therein. The serpentine cooling passages increase the cooling effectiveness by extending the length of the air flow path. In this regard, the blade may have multiple internal walls that form intricate passages through which the cooling air flows to feed the serpentine cooling passages. To further minimize blade temperatures, the blade typically includes a tip recess across its top wall. The tip recess may also be configured to minimize flow leakage across the blade top wall.

To form the above-mentioned cooling features in the blade, an investment casting process is typically employed. In one example, a single ceramic core including a bottom core portion and a top core portion is used. The bottom core portion is shaped to complement the internal cooling circuit, and the top core portion is shaped to complement the tip recess. The ceramic core is disposed in a ceramic mold having an inner surface shaped to complement an outer surface of the blade. The two ceramic core portions are held spaced apart from one another by ceramic core bridges or quartz rods to form one integrated core. Molten metal is then injected into the ceramic mold around the ceramic core. After the metal solidifies, the ceramic is leeched away from the metal, thereby exposing the blade and tip wall holes formed by the ceramic core bridges or quartz rods. The holes are utilized to flow cooling air or are plugged with a braze material to prevent cooling air leakage. In another example, a core is first used to form the blade, and the tip recess is then subsequently machined into the blade.

As engine operation temperatures have increased and internal cooling circuit designs have become more complex, some drawbacks to the above-described blades have arisen. Specifically with regard to those blades having tip wall holes, the braze material in the holes may melt when the blades are exposed to higher temperatures. Consequently, the blade may not cool as intended when air leaks out of the holes. As for blades having machined tip recesses, the core may shift out of place within the ceramic mold at some time during the manufacturing process. As a result, the tip wall may be misshapen and the tip recess may be imprecisely formed. To prevent this, costly precision locating strategies, such as repeated x-ray verification techniques could be employed; however these techniques would also increase blade manufacturing costs.

Hence, there is a need for an improved method of making a blade having a cooling system that is capable of cooling a blade tip in extreme heat environments. It would be desirable for the method to be cost-effective and relatively simple to employ.

BRIEF SUMMARY

The inventive subject matter provides a method of manufacturing an air-cooled turbine blade and a core assembly for manufacturing the blade.

In one embodiment, by way of example only, the method is used to manufacture a turbine blade having an outer surface, side walls and a tip wall, where the side walls have tip edges, the tip wall extends between the side walls and is recessed a predetermined distance from the tip edges to form a tip recess, the tip wall has a bottom surface and a top surface, and the top surface defines a portion of the tip recess. The method includes forming a ceramic mold around a first core and a second core that are adjacent one another. The ceramic mold has an inner surface shaped to complement at least a portion of the turbine blade outer surface and defining a cavity, and the first and second cores are disposed in the cavity. The first core has an outer surface shaped to complement the tip wall bottom surface. The second core has a tip surface, a side surface, and a protrusion, the tip surface is shaped to complement at least a portion of the tip wall top surface and disposed proximate the first core, the side surface is shaped to complement at least a portion of the side wall, and the protrusion extends from the second core side surface to contact at least a portion of the ceramic mold inner surface. The method also includes injecting metal into the ceramic mold cavity to at least partially cover the first and second cores. Then, a first portion of the second core and a portion of the metal and ceramic mold surrounding the second core first portion are separated from a second portion of the second core, where the first portion includes the protrusions and a first portion of the side surface and the second portion includes the tip surface and a second portion of the side surface adjacent the tip surface. The method also includes removing the second portion of the core and the ceramic mold from the metal to expose the tip recess.

In another embodiment, by way of example only, the method includes the step of forming a ceramic mold around a first core and a second core that are adjacent one another, the ceramic mold having an inner surface shaped to complement at least a portion of the turbine blade outer surface and defining a cavity, the first and second cores disposed in the cavity, the first core having an outer surface shaped to complement the tip wall bottom surface, the second core having a tip surface, a side surface, and a depression, the tip surface shaped to complement at least a portion of the tip wall top surface, the side surface shaped to complement at least a portion of the side wall, and the depression formed in the second core side surface. A locator pin is placed in the depression and in contact with at least a portion of the ceramic mold inner surface. Metal is injected into the ceramic mold cavity to at least partially cover the first and second cores and the locator pin. A first portion of the second core and a portion of the metal and ceramic mold surrounding the second core first portion is separated from a second portion of the second core, where the first portion includes the depressions and the locator pin, and a first portion of the side surface and the second portion includes the tip surface and a second portion of the side surface adjacent the tip surface. The second portion of the core and the ceramic mold is removed from the metal to expose the tip recess.

In still another embodiment, by way of example only, a core assembly is provided for disposal in a cavity of a ceramic mold, where the ceramic mold has an inner surface shaped to complement an outer surface of a turbine blade, the turbine blade further includes having an outer surface, side walls and a tip wall, the side walls have tip edges, the tip wall extends between the side walls and is recessed a predetermined distance from the tip edges to form a tip recess, the tip wall has a bottom surface and a top surface, and the top surface defining a portion of the tip recess. The core assembly includes two cores. The first core has an outer surface shaped to complement the tip wall bottom surface. The second core has a tip surface, a side surface, and a set of protrusions. The tip surface is shaped to complement at least a portion of the tip wall top surface and is configured to be disposed in contact with the first core standoff point. The side surface is shaped to complement at least a portion of the side wall, and the protrusions extend from the second core side surface to contact at least a portion of the ceramic mold inner surface.

In still another embodiment, the first core has an outer surface shaped to complement the tip wall bottom surface. The second core has a tip surface, a side surface, and a depression, the tip surface is shaped to complement at least a portion of the tip wall top surface and is configured to be disposed in contact with the first core standoff point, the side surface is shaped to complement at least a portion of the side wall, and the depression is formed in the second core side surface configured to receive a portion of a locator pin including an end configured to contact at least a portion of the ceramic mold inner surface.

Other independent features and advantages of the preferred blade will become apparent from the following detailed description, taken in conjunction with the accompanying drawings which illustrate, by way of example, the principles of the inventive subject matter.

DETAILED DESCRIPTION OF A PREFERRED EMBODIMENT

The following detailed description of the inventive subject matter is merely exemplary in nature and is not intended to limit the inventive subject matter or the application and uses of the inventive subject matter. Furthermore, there is no intention to be bound by any theory presented in the preceding background or the following detailed description.

Figure 1:
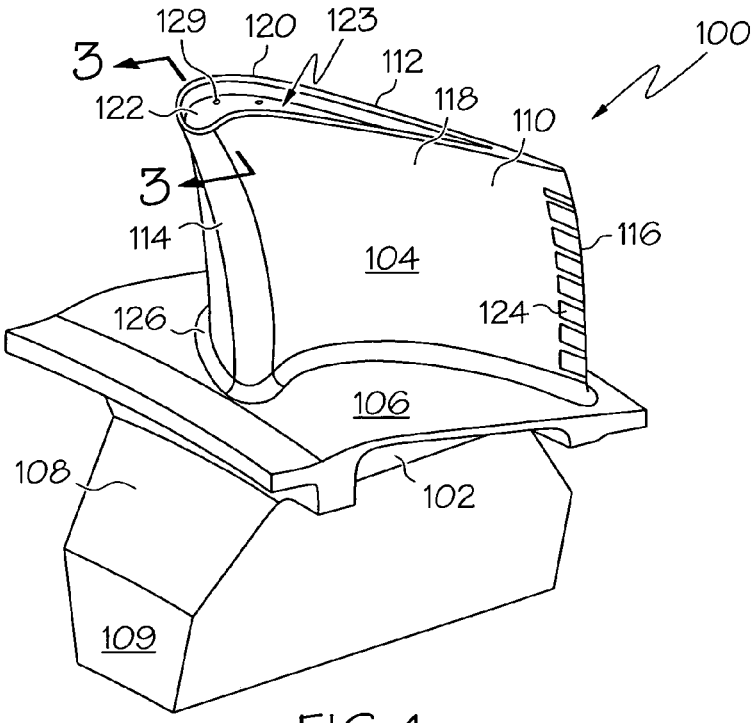
FIG. 1 is a perspective pressure (concave) side view of an engine turbine rotor blade that incorporates an airfoil of the blade according to an exemplary embodiment.
Figure 2:
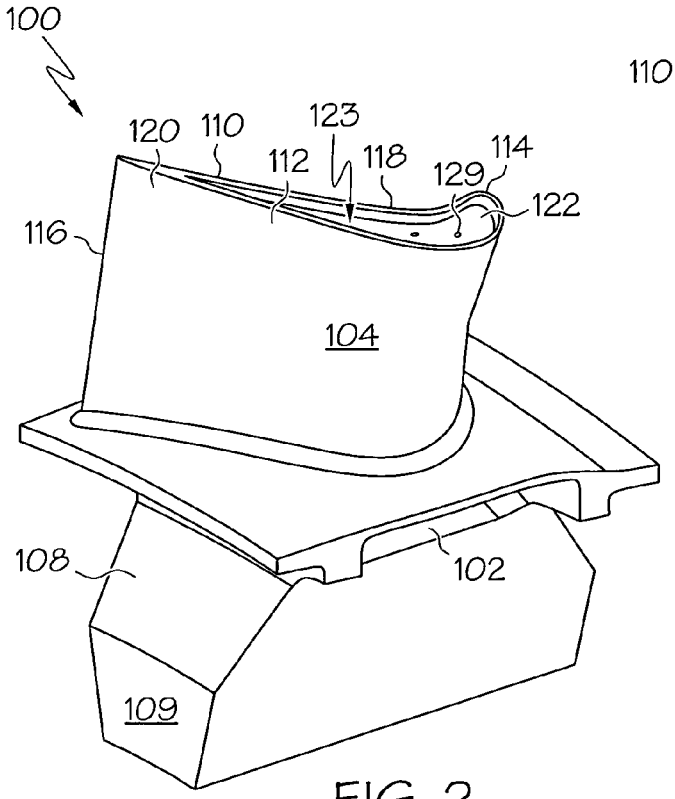
FIG. 2 is a perspective suction (convex) side view of the engine turbine rotor blade of FIG. 1 according to an exemplary embodiment.

FIGS. 1 and 2 illustrate an exemplary aircraft jet engine turbine rotor blade 100 that includes a shank 102, an airfoil 104, a platform 106 and a root 108. The platform 106 is configured to radially contain turbine airflow. The root 108 provides an area in which a firtree 109 is machined. The firtree 109 is used to attach the blade 100 to a turbine rotor disc (not illustrated). It will be appreciated that in other embodiments, any one of numerous other shapes suitable for attaching the blade 100 to the turbine disk, may be alternatively machined therein. The airfoil 104 has a concave outer wall 110 and a convex outer wall 112, each having outer surfaces that together define an airfoil shape. The airfoil shape includes a leading edge 114, a trailing edge 116, a pressure side 118 along the first outer wall 110, a suction side 120 along the second outer wall 112, one or more trailing edge slots 124, and an airfoil platform fillet 126.

Figure 3:
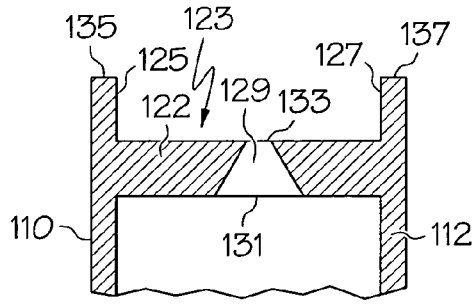
FIG. 3 is a close up cross-section view of a tip wall portion of the blade shown in FIGS. 1 and 2 according to an exemplary embodiment.

The blade 100 also includes a blade tip wall 122 that extends between and couples the first and second outer walls 110, 112 together. In some embodiments, the blade tip wall 122 may include one or more tapered openings 129 formed therethrough. As shown in FIG. 3, the openings 129 are formed such that each has an inlet 131 that is greater in area than a corresponding outlet 133. The blade tip wall 122 is preferably recessed a predetermined distance from top edges 135, 137 of the outer walls 110, 112 to thereby define a tip recess 123 with inwardly facing surfaces 125, 127 of the outer walls 110, 112.

Figure 4:
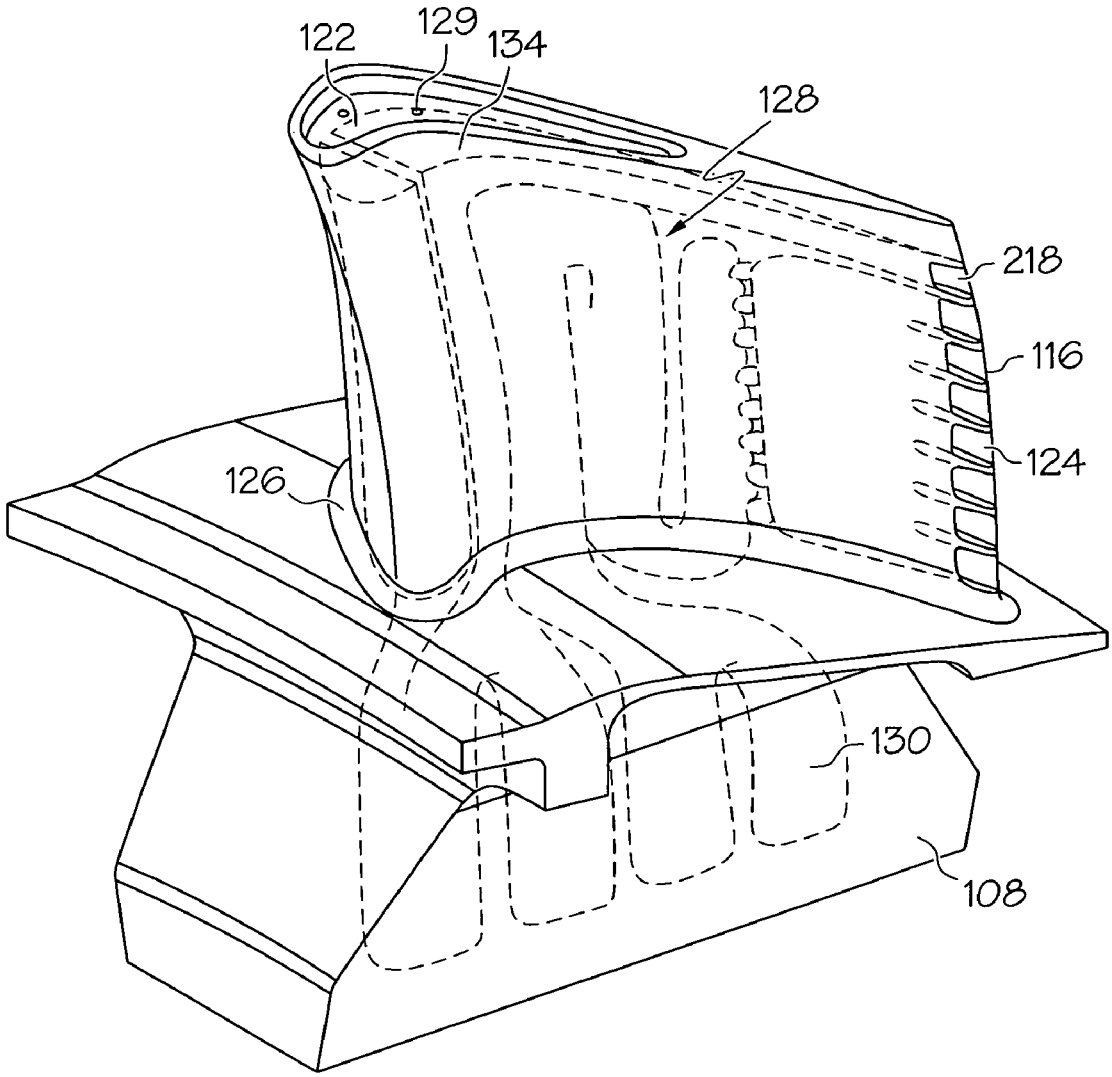
FIG. 4 is a perspective view of the blade showing the blade cooling circuits in dotted lines according to an exemplary embodiment.
Figure 5:
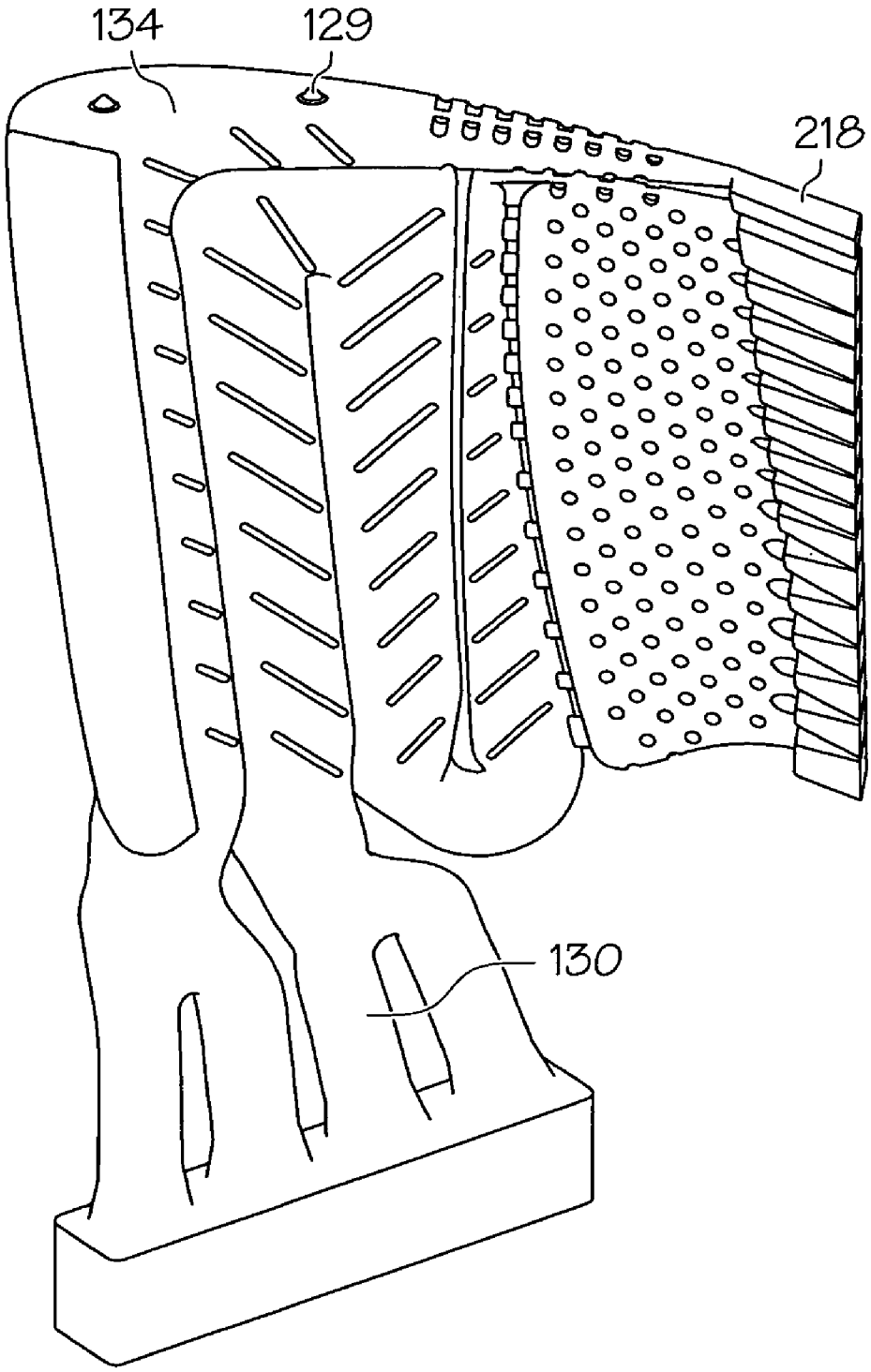
FIG. 5 is a reverse image of a pressure side view of exemplary cooling circuits shown in FIG. 4 according to an exemplary embodiment.

Turning now to FIGS. 4 and 5, perspective views of the blade 100 and reverse images of an internal cooling circuit 128 formed in the blade 100 are provided. The internal cooling circuit 128 is configured to cool the pressure side wall 110, suction side wall 112, and tip wall 122 by directing air from one or more inlets 130 formed in the root 108, to the trailing edge slots 124, to openings 129, or to a trailing edge exit 218. The internal cooling circuit 128 is made up of a plurality of flow passages, including a tip flow passage 134. The tip flow passage 134 receives air and directs the air along the tip wall 122. The air exits the tip flow circuit 134 via a trailing edge exit 218 or through one or more of the openings 129.

Figure 6:
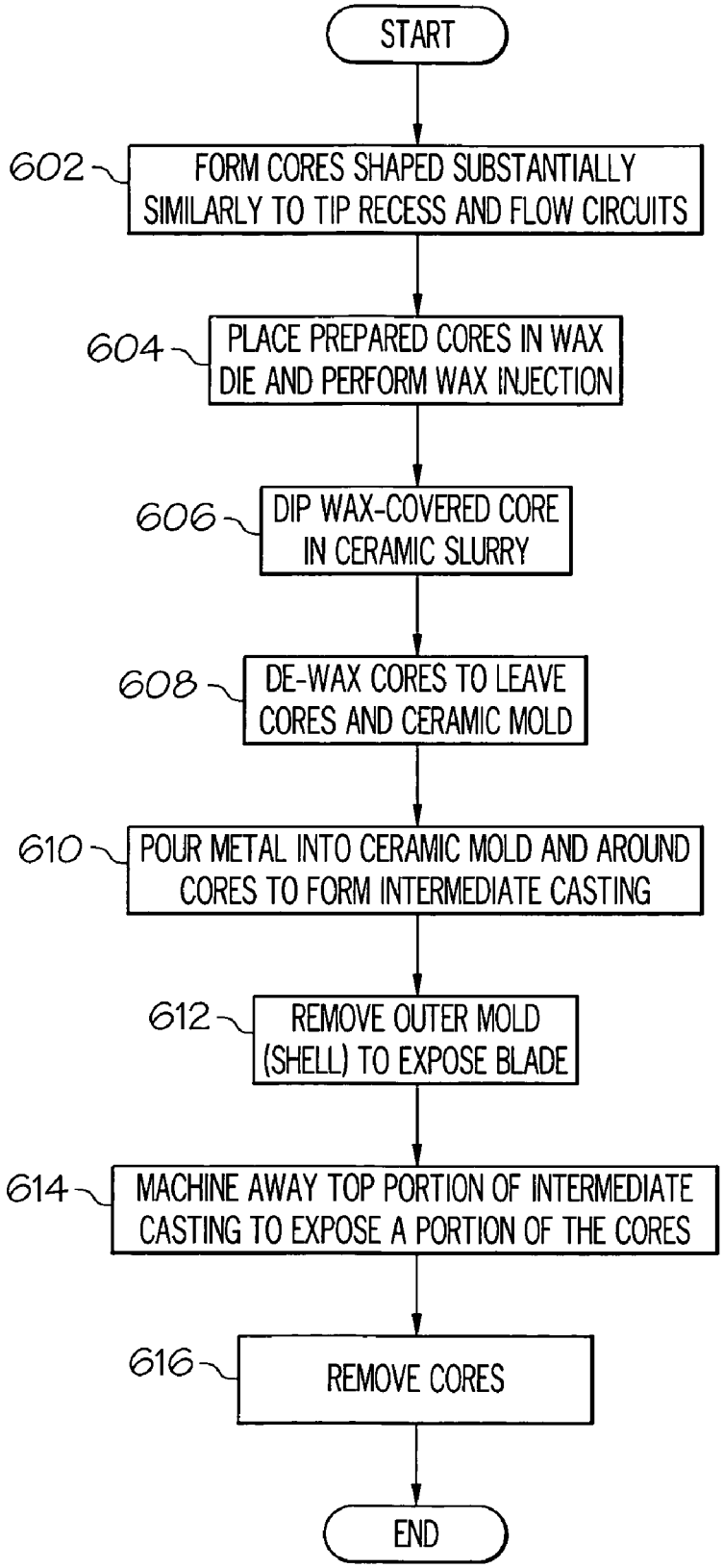
FIG. 6 is a flow diagram of an exemplary method of manufacturing the blade shown in FIGS. 1 and 2 according to an exemplary embodiment.

The blade 100 is produced using an exemplary method 600 illustrated in FIG. 6. First, cores are formed that are shaped at least substantially similarly to the tip recess 123 and internal flow circuit 128, step 602. The cores are placed in a wax die and substantially covered with wax, step 604. The inner surface of the wax die is shaped to complement the airfoil outer surface. Next, the wax-covered cores are then dipped in a ceramic slurry, step 606. Next, the cores are de-waxed leaving the cores and an outer ceramic mold, step 608. Metal is poured into the ceramic mold around the cores to form an intermediate casting, step 610. After metal solidification, the outer ceramic mold is removed to expose the airfoils, step 612. Next, a top portion of the intermediate casting is machined away to expose a portion of the cores, step 614. Then the internal cores are removed from the blade 100, step 616. Each of these steps will now be discussed in more detail below.

As briefly mentioned above, the cores are first formed and are shaped at least substantially similarly to the airfoil internal cooling circuit 128 and tip recess 123, step 602. In one exemplary embodiment shown in FIG. 7, the internal cooling circuit core 704 is formed to provide definition of internal cooling features of the blade 100 while a tip recess core 720 is formed to define the tip recess 123.

The internal cooling circuit core 704 includes a pilot 718, that may be a T-bar (shown in FIG. 7) or a stem section that maintains the position of the internal cooling circuit core 704 throughout at least a portion of the method 600. To maintain the internal cooling circuit core 704 a predetermined distance apart from the tip recess core 720, one or more tapered standoffs 722 are included on a tip flow portion 706 of the internal cooling circuit core 704. The tapered standoffs 722 are formed such that each has a thickness that is at least equal to a desired thickness of the blade tip wall 122. In one embodiment, each tapered standoff 722 has a point 724 formed thereon that contacts a minimal amount of surface area on the tip recess core 720. The point 724 may be rounded or sharp.

The tip recess core 720 has a tip surface 725 and side surfaces 729, 730. The tip surface 725 is configured to contact the tapered standoff 722 and is shaped substantially similarly to the outer surface of the tip wall 122. The side surfaces 729,730 include portions 731, 733 shaped substantially similarly to inwardly facing surfaces 125, 127 of the outer walls 110, 112 (shown in FIG. 3) and each may include one or more protrusions 726 extending therefrom. The protrusion 726 prevents the core 720 from moving laterally in later steps and is preferably disposed on the side surfaces 729, 730, a predetermined distance away from the tip surface 725. The predetermined distance is preferably a length that is greater than a distance between the tip wall 122 and the top edges 135, 137 of the outer walls 110, 112.

Figure 7:
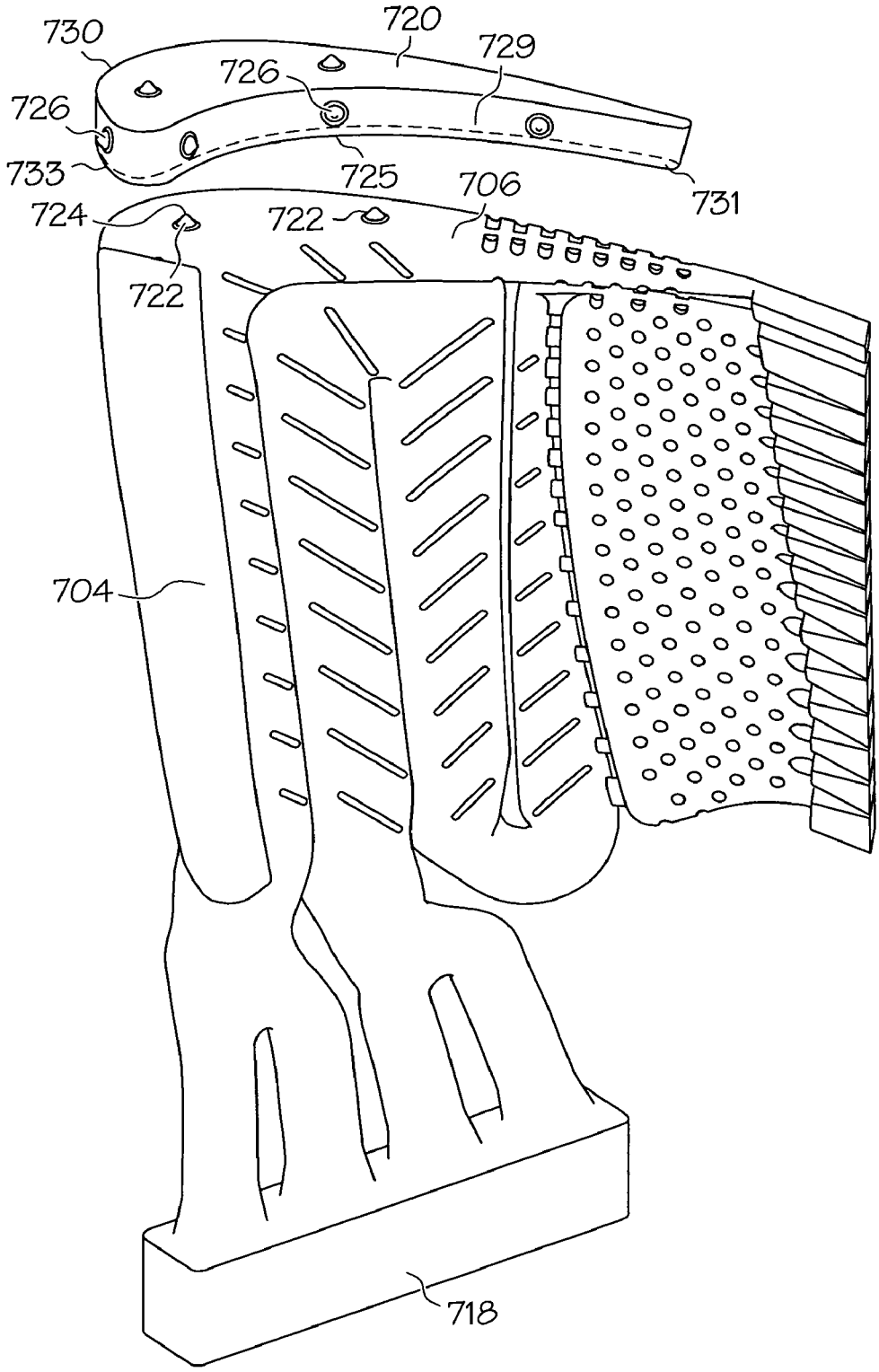
FIG. 7 is a perspective view of a plurality of cooling circuit and tip recess cores that may be used to form the blades shown in FIGS. 1-4 according to an exemplary embodiment.

The protrusion 726 may have any one of numerous suitable shapes. In one exemplary embodiment, as shown in FIG. 7, more than one protrusion 726 may be included that may be shaped substantially similarly to a standoff. In this case, the standoff-type protrusion 726 is preferably formed such that, when the tip recess core 720 is later disposed within a die cavity, it is spaced a predetermined distance away from the surface defining the die cavity. In some embodiments, the tip wall radial standoffs 722 may not be incorporated so that a robust tip wall 122 is formed without holes that may leak cooling out the blade tip wall 122. Such an embodiment may be advantageous to reduce costs, as subsequent braze operations may not be needed.

Figure 8:
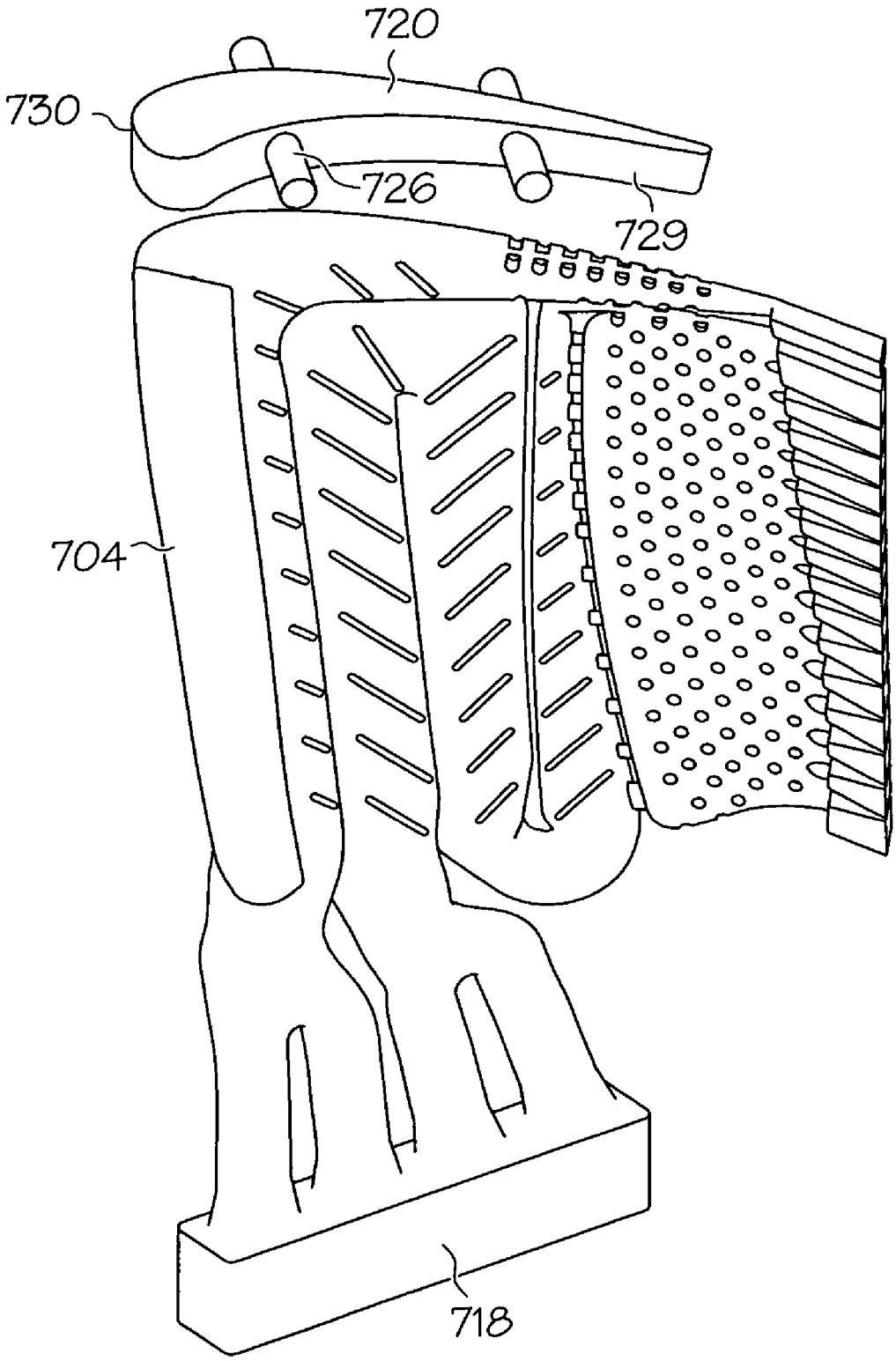
FIG. 8 is a perspective view of a plurality of cooling circuit and tip recess cores that may be used to form the blades shown in FIGS. 1-4 according to another exemplary embodiment.

In other embodiments, the protrusions are extensions. In one example, illustrated in FIG. 8, the tip recess core 720 is shown proximate the internal cooling circuit core 704. The tip recess core 720 includes extension-type protrusions 726 that are rod shaped and that extend a suitable distance away from the side surfaces 729 and 730. As a result, the tip recess core 720 may be secured in an outer ceramic mold formed in later steps. Specifically, these protrusions 726 prevent the tip recess core 720 from moving laterally in later steps, such as in step 608 or step 610. In addition, the protrusions 726 serve as a pilot for the tip recess core 720 to maintain an appropriate wall thickness of the blade tip outer wall 122. In this embodiment, the tapered stand-offs 722 of the internal cooling circuit 704 may or may not be included.

Figure 9:
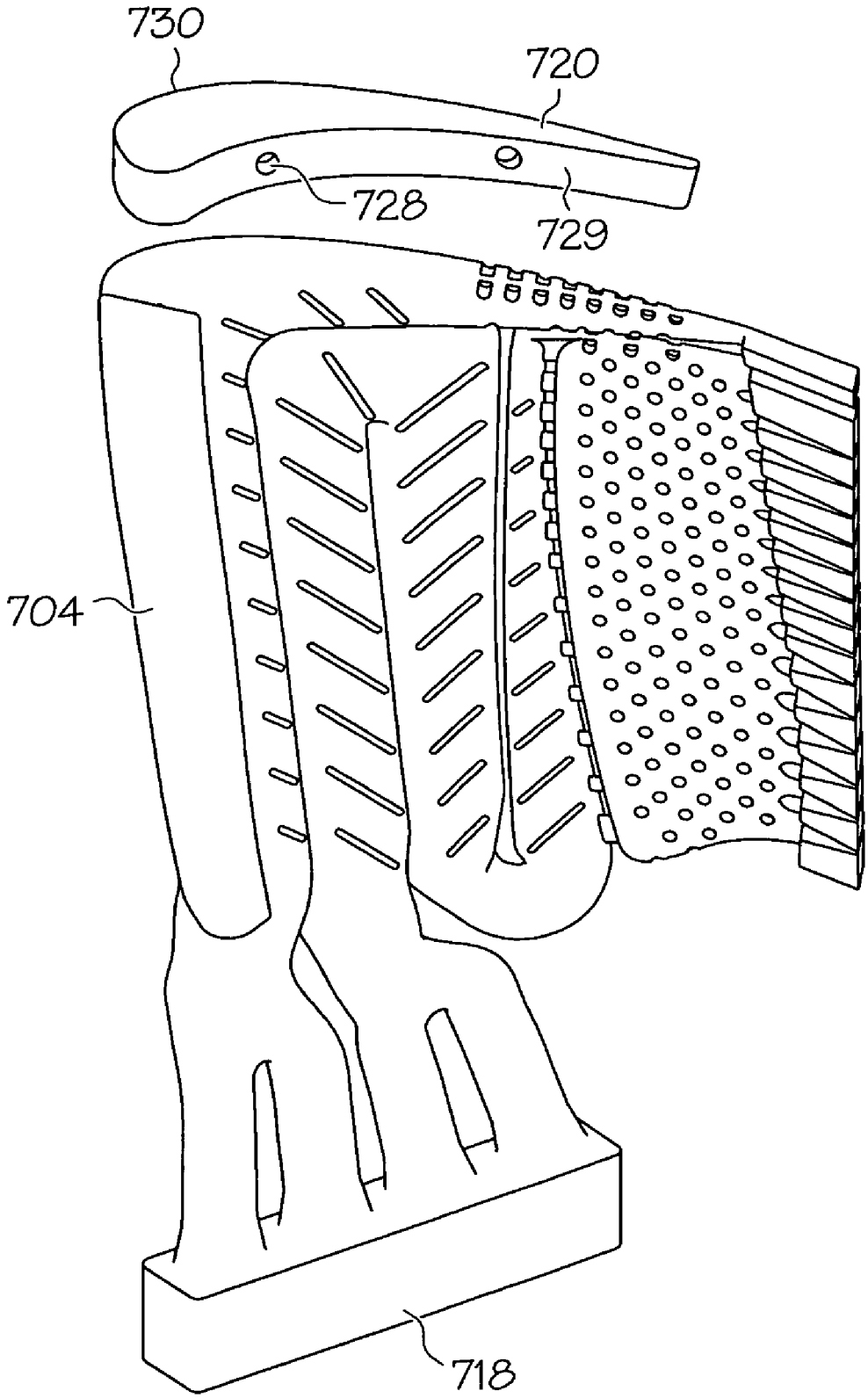
FIG. 9 is a perspective view of a plurality of cooling circuit and tip recess cores that may be used to form the blades shown in FIGS. 1-4 according to still another exemplary embodiment.

In still other embodiments, the tip recess core 720 includes negative spaces 728 formed therein, as shown in FIG. 9. The negative spaces 728 may be depressions. In this embodiment, the tapered stand-offs 722 of the internal cooling circuit 704 may or may not be included.

The cores 704 and 720 are preferably formed from ceramic. In some embodiments, the standoffs 722 and protrusions 726 are integrally formed with the tip flow portion 706 of the internal cooling circuit core 704 and with the tip recess core 720, respectively. In other embodiments, the protrusions 726 are made of a metal, such as platinum, that has a melting point that is substantially equal to or higher than that of the metal that will be used to make the blade 100. In yet other embodiments, the extended-type protrusions 726 may be made of ceramic quartz rods that may be secured to the tip core 720.

After the cores 704, 720 are formed, they are placed in a wax die and substantially covered in wax to form a wax pattern, step 604. Wax may be placed in the wax die in any suitable conventional manner, such as by, for example, injection. In embodiments in which the standoffs 722 and protrusions 726 are integrally formed with the internal cooling circuit core 704 and tip recess core 720, the protrusions 726 may not be completely covered with wax and may remain exposed. In embodiments in which, the tip recess core 720 includes extended-type protrusions 726, the tips of the protrusions 726 may not be completely covered with wax after the wax injection process 604.

In embodiments in which the standoffs 722 and internal cooling circuit core 704 are not integrally formed, the standoffs 722 may be placed on the tip flow portion 706 before being covered in the molten wax so that the tip flow portion 706 remains spaced apart from the tip recess core 720. When melted wax flows around and solidifies around the cores 704, 720, the cores 704, 720 are maintained spaced apart.

In still other embodiments in which the tip recess core 720 includes negative spaces 728, corresponding pins (not shown) that can serve as locators (not shown) may be placed in the wax die that engage the depressions 728 for positioning the tip core 720 with respect to the internal cooling circuit core 704. Thus, the depressions 728 form pockets that will be filled with the ceramic mold material during subsequent steps, such as in step 606, so that the ceramic mold formed in step 606 securely holds the cores 704, 720 a suitable distance apart from each other during step 608 and step 610.

After the wax pattern is formed, it is dipped in a ceramic slurry and dried to form a ceramic outer mold, step 606. Specifically, the ceramic slurry preferably substantially covers the wax pattern and cores 704, 720. After the ceramic slurry dries, it is de-waxed, step 608. As a result, the ceramic outer mold forms a cavity within which the cores 704, 720 are disposed.

Molten metal is injected into the cavity to at least partially surround the cores 704, 720, step 610. In one exemplary embodiment, the outer mold and cores 704, 720 are placed in a furnace, heated, and filled with the metal material. It will be appreciated that the metal material may be any one of numerous metal materials suitable for forming the blade 100, such, as, for example, nickel-based superalloys, which may be equi-axed, directionally solidified, or single crystal. In embodiments in which the protrusions 726 are metal, for example platinum pins, they may melt and incorporate with the injected metal. After the metal cools and solidifies, an intermediate casting results.

The outer mold is then removed to expose the blade 100, step 612. Next, a top portion of the intermediate casting is machined away to expose a portion of the core 720, step 614. Then the cores 704, 720 are removed from the blade 100, step 616. Consequently, cavities are left in the blade 100 forming the internal cooling circuit 128 and the tip recess 123. In one exemplary embodiment, the cores 706 and 720 are chemically removed from the airfoil 104 using a suitably formulated composition that dissolves the cores. The core material is typically leached out using a traditional caustic solution, such as sodium or potassium hydroxide, as is common in the core removal industry. Verification of core removal may be accomplished using a combination of water flow, air flow, N-ray, and thermal imaging inspections.

Hence, a new blade having improved cooling and tip cap wall thickness capabilities over previously known blades has been provided. The improved blade may be used in high temperature applications and has improved structural integrity when exposed thereto. Additionally, a method for forming the improved blade has also been provided. The method may be incorporated into existing manufacturing processes and is relatively simple and inexpensive to implement.

While the inventive subject matter has been described with reference to a preferred embodiment, it will be understood by those skilled in the art that various changes may be made and equivalents may be substituted for elements thereof without departing from the scope of the inventive subject matter. In addition, many modifications may be made to adapt to a particular situation or material to the teachings of the inventive subject matter without departing from the essential scope thereof. Therefore, it is intended that the inventive subject matter not be limited to the particular embodiment disclosed as the best mode contemplated for carrying out this inventive subject matter, but that the inventive subject matter will include all embodiments falling within the scope of the appended claims.

We claim:

1. A method of manufacturing an air-cooled turbine blade having an outer surface, side walls and a tip wall, the side walls having tip edges, the tip wall extending between the side walls and recessed a predetermined distance from the tip edges to form a tip recess, the tip wall having a bottom surface and a top surface, the top surface defining a portion of the tip recess, the method comprising the steps of:

forming a ceramic mold around cores consisting of a first core and a second core that are adjacent and not coupled to one another, the ceramic mold having an inner surface shaped to complement at least a portion of the turbine blade outer surface and defining a cavity, the first and second cores disposed in the cavity, the first core having an outer surface shaped to complement the tip wall bottom surface, the second core having a tip surface, a side surface, and a protrusion, the tip surface shaped to complement at least a portion of the tip wall top surface and disposed proximate the first core outer surface, the side surface shaped to complement at least a portion of the side wall, and the protrusion extending from the second core side surface to contact at least a portion of the ceramic mold inner surface and comprising a platinum pin;

injecting metal into the ceramic mold cavity to at least partially cover the first and second cores to melt the platinum pin and incorporate the platinum pin into the metal;

separating a first portion of the second core and ceramic mold surrounding the first portion of the second core from a second portion of the second core, the first portion of the second core including an area located inwardly from the protrusion and a first portion of the side surface of the second core, the second portion of the second core including the tip surface of the second core and a second portion of the side surface adjacent the tip surface; and removing the second portion of the second core and the ceramic mold from the metal to expose the tip recess and the blade, and wherein the platinum pin of the projection remains incorporated in the blade.

2. The method of claim 1, wherein the step of forming comprises:

placing the cores in a cavity of a die having an inner surface shaped to complement the blade outer surface and substantially covering the first and second cores with wax;

removing the die from the wax-covered first and second cores;

dipping the wax-covered first and second cores into a ceramic slurry to form the ceramic mold; and removing the wax from the wax-covered first and second cores to expose the ceramic mold cavity.

3. The method of claim 2, wherein the second core protrusion comprises one or more standoffs and the step of dipping the wax-covered first and second cores further comprises covering a portion of the protrusion in the ceramic slurry.

4. The method of claim 2, wherein the second core protrusion forms an extended protrusion and the step of dipping the wax-covered first and second cores further comprises covering a portion of the extended protrusion in the ceramic slurry.

5. The method of claim 1, wherein the step of forming comprises forming the ceramic mold around a first core having one or more tapered standoffs extending from the first core outer surface and each having a point.

6. The method of claim 5, further comprising integrally forming the one or more tapered standoffs and the first core from ceramic.

7. The method of claim 5, further comprising forming one or more tapered standoffs from a metal having a melting point that is substantially equal to or above that of the injected metal and placing the one or more tapered standoffs on a predetermined location on the first core outer surface.

8. A method of manufacturing an air-cooled turbine blade having an outer surface, side walls and a tip wall, the side walls having tip edges, the tip wall extending between the side walls and recessed a predetermined distance from the tip edges to form a tip recess, the tip wall having a bottom surface and a top surface, the top surface defining a portion of the tip recess, the method comprising the steps of forming a ceramic mold around cores consisting only of a first core and a second core that are adjacent to and not coupled one another, the ceramic mold having an inner surface shaped to complement at least a portion of the turbine blade outer surface and defining a cavity, the first core having an outer surface shaped to complement the tip wall bottom surface, the second core having a tip surface, a side surface, and a protrusion, the tip surface shaped to complement at least a portion of the tip wall top surface and disposed proximate the first core outer surface, the side surface shaped to complement at least a portion of the side wall, and the protrusion extending from the second core side surface to contact at least a portion of the ceramic mold inner surface;

injecting metal into the ceramic mold cavity to cover the first and second cores;

separating a first portion of the second core and ceramic mold surrounding the first portion of the second core from a second portion of the second core, the first portion of the second core including an area located inwardly from the protrusion and a first portion of the side surface of the second core, the second portion of the second core including the tip surface of the second core and a second portion of the side surface adjacent the tip surface; and removing the second portion of the second core and the ceramic mold from the metal to expose the tip recess and the blade.

9. The method of claim 8, wherein the step of forming comprises forming the ceramic mold around a first core having one or more tapered standoffs extending from the first core outer surface and each having a point.

10. The method of claim 9, further comprising integrally forming the one or more tapered standoffs and the first core from ceramic.

11. The method of claim 9, further comprising forming one or more tapered standoffs from a metal having a melting point that is substantially equal to or above that of the injected metal and placing the one or more tapered standoffs on a predetermined location on the first core outer surface.

* * * * *